United States Patent [19]

Spanjer et al.

[11] Patent Number: 4,827,184

[45] Date of Patent: May 2, 1989

[54] ELECTRON BEAM DEVICE AND A FOCUSING LENS THEREFOR

[75] Inventors: Tjerk G. Spanjer; Gerardus A. H. M. Vrijssen, both of Eindhoven, Netherlands

[73] Assignee: U.S. Philips Corporation, New York, N.Y.

[21] Appl. No.: 145,797

[22] Filed: Jan. 19, 1988

[30] Foreign Application Priority Data

Jan. 21, 1987 [GB] United Kingdom ..... 8701289

[51] Int. Cl.[4] ..... H01J 29/46

[52] U.S. Cl. ..... 313/450; 313/452; 313/479; 313/432; 313/439; 315/3

[58] Field of Search ..... 315/3, 382; 313/450, 313/452, 479, 432, 439

[56] References Cited

U.S. PATENT DOCUMENTS

| | | | |
|---|---|---|---|
| 3,143,681 | 8/1964 | Schlesinger | 313/450 |
| 3,268,114 | 11/1966 | Schlesinger | 313/450 |
| 3,327,160 | 6/1967 | Schlesinger | 313/450 X |
| 3,758,802 | 9/1973 | Kubo et al. | 313/479 |
| 4,211,953 | 7/1980 | Rybalko | 313/450 |
| 4,561,996 | 12/1985 | Holmes et al. | 427/126.5 X |

*Primary Examiner*—David K. Moore
*Assistant Examiner*—Michael Horabik
*Attorney, Agent, or Firm*—Robert J. Krauss

[57] ABSTRACT

An electron beam device such as a cathode ray tube in which spherical aberration is reduced by optimising the axial potential distribution in the focusing lens of the electron gun. In one embodiment of the invention the electron gun comprises a beam forming part and a segmented focusing lens (25). The focusing lens (25) comprises a preformed glass tube (22) having a high-ohmic resistive layer (23) on the interior wall thereof, the resistive layer (23) comprises helical segments (33 to 37) alternated with intermediate segments (42 to 47). A focusing voltage is applied to the intermediate section (42) closest to the beam forming part and a higher voltage is applied to the end segment (47). The lengths of the helical segments (33 to 37) increase in a direction from the point of application of the focusing voltage whereas the lengths of the intermediate segments (42 to 46) decrease. The lengths of the helical segments (33 37) are such as to produce the desired axial potential distribution.

12 Claims, 5 Drawing Sheets

ELECTRON BEAM DEVICE AND A FOCUSING LENS THEREFOR

BACKGROUND OF THE INVENTION

The present invention relates to an electron beam device having a focusing lens. In the present specification the term electron beam device is to be understood to include cathode ray tubes, X-ray tubes, electron beam lithography apparatus, scanning and transmission electron microscopes, electron guns for scanning auger mass spectrometers and also ion guns (not an electron beam device within the normal meaning of the term). For convenience of description, the electron beam device will be described with reference to a cathode ray tube.

Known types of focusing lenses for cathode ray tubes, for example display tubes, are electrostatic bipotential and unipotential lenses, combinations thereof and magnetic lenses. In general, the spherical aberration of lenses decreases with increasing lens diameter.

In the case of electrostatic lenses the maximum diameter is limited by the diameter of the tube neck. However, this restriction does not apply to magnetic lenses, but these are unattractive anyway because of their high power dissipation, their extra weight, the rotation of the electron beam and alignment problems.

It is known, for example from U.S. Pat. No. 4,370,594, that spherical aberration can be reduced by using an electron lens having a long focal length. This specification describes an embodiment of a bipotential lens having two spaced apart cylindrical lens electrodes carried by glass rods in the customary manner. Between the lens electrodes is provided a resistive stack comprising a plurality of plates electrically insulated from each other by means of blocks of an electrically insulating material. A resistive layer bridges the insulating blocks so that a small current can flow therethrough to enable an electric field to be set-up.

U.S. Pat. No. 3,995,194 discloses another electron gun having an extended field focusing lens comprising at least three, and preferably four, discrete focusing electrodes at different voltages which establish a single, continuous electrostatic focusing field during tube operation which field decreases smoothly and monotonically from an intermediate relative potential to a relatively low potential and then increases smoothly, directly and monotonically from the relatively low potential to a relatively high potential. An electron lens disclosed in U.S. Pat. No. 4,124,810 seeks to improve on this prior electron gun by having a distributed electron lens constituted by three electrodes which are at progressively higher voltages in the path of movement of the electron beam from the electron gun to the screen. It is said that a smaller electron spot than that obtained with the previously described electron gun (U.S. Pat. No. 3,995,194) is achieved, if the length of the intermediate electrode of the three electrodes is substantially equal to the lens radius and preferably the voltage change across the intermediate electrode of the three electrodes increases monotonically along the beam path and closely approximates an exponential curve.

All these known lenses require the precision assembly of discrete electrodes which are spatially positioned relative to each other by glass rods. In many cases, each of the electrodes requires a separate voltage supply which in turn means a respective external connection. As the trend in display tube manufacture is towards narrower necks then the size of the electron guns becomes smaller leading to increase of the spherical aberration. Consequently the use of discrete electrodes having their own external connection mitigates such a trend.

In the case of single gun tubes used for monochromatic display there have been proposals for helical electrostatic electron lenses formed by providing conductive helices either directly on the interior of the tube envelope or on the interior of a tubular element of an electrically insulating material, which element forms part of the electron gun. U.S. Pat. No. 3,143,681 discloses that it can be shown mathematically that focusing of an electron beam having axial symmetry can be obtained with a minimum of spherical aberration by an electrostatic field having equipotential surfaces which are co-asymptotic hyberboloids of revolution rotationally symmetrical about the beam axis. A field having the desired hyperboidal equipotential surfaces can be produced by a single electrode consisting of a continuous helical conductor disposed coaxially with a reference axis which may be the longitudinal axis of a cathode ray tube, and having a physical configuration and electrical resistance characteristics such as to produce a space potential at the reference axis which potential varies as a quadratic function of displacement along the reference axis. The specification discloses that the variation in voltage along the helical conductor can be provided by for example varying the effective resistivity of the helical conductor, varying its cross-sectional dimensions, varying its pitch, varying the proportion of turn width to turn spacing, or varying two or more of the foregoing factors in combination to provide a non-linear or non-uniform conductor. Additionally the citation suggests that the desired voltage variation may be achieved by a series of stepped helices, each step or increment being in itself linear but the aggregate having an overall non-linear effect, much as a curve can be approximated by a series of straight lines. However in order to fulfill the required space potential on the electron gun axis it is desirable that the or each helix be terminated by a physical field boundary element having a shape corresponding substantially to the contour of the desired adjacent field equipotential. Such field boundary elements, which may comprise plates or meshes, may as a result of electron impingement form local sources of heat. Such plates and meshes are relatively difficult to design and fabricate and therefore constitute an extra cost item. The presence of such plates and meshes are also undesirable in electron beam devices because they intercept part of the beam current leading to a loss of brightness.

In spite of these proposals no satisfactory general solution exists for designing focusing lenses having a low spherical aberration, which lenses can be used in narrow necked display tubes such as projection television tubes.

SUMMARY OF THE INVENTION

An object of the present invention is to provide an electron gun having an electron lens with a low spherical aberration.

According to the present invention there is provided an electron beam device having an electron gun including a beam forming part and a focusing lens, the focusing lens comprising an elongate tubular substrate of an electrically insulating material, a high-ohmic resistive layer on the internal surface of the substrate, electrical connections to two axially separate points of the resistive layer, the resistance of the resistive layer between said axially separate points being adapted to produce a predetermined axial potential distribution therebetween in response to the application of a focusing voltage at one of said points and a different voltage at the other of said points to provide an electron lens having an optimised resolution.

By means of the present invention an extended field lens is created with equal, or smaller than conventional, diameter electrodes. Thus a lens is created having a small physical diameter but a large effective diameter, for example a lens having an actual diameter of 10 mm can be created so that it has an effective diameter of 40 mm which means that it has the same spherical aberration as a conventional bipotential lens having a physical diameter of 40 mm.

The invention is based on the optimisation of the lens potential distribution with respect to the factor $C^{\frac{1}{4}}$. In Optik, 72 No. 4 (1986) pages 134 to 136, "A generalized comparison of spherical aberration of magnetic and electrostatic lenses" the authors A. A. van Gorkum and T. G. Spanjer have shown that starting from an object with finite brightness the minimum obtainable spot size at the screen is linearly proportional to $C^{\frac{1}{4}}$, where C is the spherical aberration constant with respect to the image side of the lens which constant is related to the object side spherical aberration constant $C_s$ by $$C = M^4 C_s \left(\frac{V_2}{V_1}\right)^{3/2}$$

where M is the linear magnification, $V_1$ is the potential at the object side of the lens, and $V_2$ is the potential at the image side of the lens. $C_2$ can be calculated from the integral along the axis (Z) of $$C_s = \frac{1}{64\sqrt{V_o}} \int_p^Q \frac{R^4}{\sqrt{V^1}} \left[10\left(\frac{V^1}{V}\right)^4 - 10\left(\frac{V^1}{V}\right)^2\left(\frac{V^{11}}{V}\right) + 4\left(\frac{V^{11}}{V}\right)^2 - \left(\frac{V^1}{V}\right)\cdot\left(\frac{V^{111}}{V}\right)\right] dz$$

where R is the radius of the paraxial path starting at the object point (that is Z=P) at a 1 radian angle and V is the axis potential and $V^1$, $V^{11}$ and $V^{111}$ are derivatives of the axis potential, and Q is the image point, that is Z=Q. An electron lens which closely approximates the optimal potential distribution and is fabricated using discrete metal electrodes, each with its own voltage supply line would be very complicated to construct and would not lend itself to manufacture by mass production methods. The electron gun used in the device made in accordance with the present invention is simple in its construction requiring only two external connections and can be made to approximate closely the optimal potential distribution.

One method by which this optimisation can be achieved is by providing a high-ohmic resistive layer comprising alternate helices and intermediate segments of mutually different lengths to optimise the axial potential and its three derivatives. In the case of a bipotential focusing lens, the lengths of the helices and intermediate segments are such that, proceeding in a direction from the electron beam generating section of the electron gun, the intermediate sections are progressively shorter whilst the intervening helices are progressively longer. The minimum length of a helical segment is one turn. The number of helical segments is in theory limitless but a practical maximum is of the order of 9 helical segments whilst a typical value is five because the improvement in spherical aberration gained by a larger number of helical segments becomes less and less.

Although the helical segments may have a continuously varying pitch to optimise the potential difference across each one, it has been found that a segmented lens having constant pitch helices can provide an acceptable spherical aberration. The reason for this is that the spherical aberration is dependent on the axis potential and that great variations in the potential distribution along the helix become apparent to only a slight extent in the variation of the axis potential.

Another advantage of a segmented helical lens having a constant pitch is that it can be made very easily for example by rotating the elongate tubular substrate having a continuous high ohmic resistive layer on the internal surface thereof at a constant speed and scratching a helical track at the area of the segments using a chisel, or forming such a track with a laser, which is moved parallel to the axis.

Another means of implementing the focusing lens is to form a continuous helix of variable pitch and/or variable band width. However irrespective of whether reach of the helical segments or the complete helix is of variable pitch, the region over which the pitch can be varied is limited due to the fact that the minimum band width of a turn of the helix must be sufficiently large as to render negligible the effect of any irregularities of its edges on the resistance. Other factors which also have to be taken into account are that a too large turn spacing may lead to charging of the insulating substrate of the tubular member. Additionally a large band width is undesirable because the potential along this band in the axial direction is constant. However one method by which these problems may be alleviated is by having two or more interleaved coarsely wound helices, each helix at its respective ends being connected to the finer pitch helices, thus this combination of coarsely wound helices represents an equivalent number of parallel connected resistors.

Another method by which the voltage distribution produced by the high-ohmic resistance layer can be optimised is to vary the thickness of the layer or its resistivity for example in accordance with a succession of cylindrical area of different lengths with or without helices.

The tubular substrate may comprise the neck of the cathode ray tube or may comprise a separate member mounted within the neck and forming a part of the electron gun, the other part being the electron beam generating section.

Optionally a prefocusing lens may be provided between the electron beam generating section and the main focusing lens, the prefocusing lens comprising a further helix in the resistive layer.

BRIEF DESCRIPTION OF THE DRAWING

The present invention will now be described, by way of example, with reference to the accompanying drawing figures, wherein.

In the drawing figures, corresponding reference numerals have been used to indicate the same parts.

DESCRIPTION OF THE PREFERRED EMBODIMENTS

Figure 1:
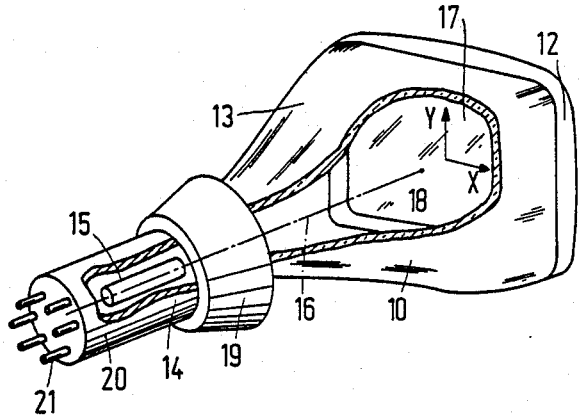
FIG. 1 is a perspective view of a monochrome display tube, for example a projection television tube, with a portion of the envelope wall broken away.

Referring initially to FIG. 1, the monochrome display tube comprises an evaucated envelope 10 formed by an optically transparent faceplate 12, a conical portion 13 and a neck 14. An electron gun 15 is mounted substantially coaxially in the neck 14. An electron beam 16 produced by the electron gun 15 forms a spot 18 on a cathodoluminescent screen 17 provided on the internal surface of the faceplate 12. A magnetic deflection yoke 19 scans the spot 18 in the X and Y directions across the screen 17. External connections to the electrodes of the electron gun 15 are by means of pins 21 in a glass end cap 20 fused to the neck 14.

Figure 2:
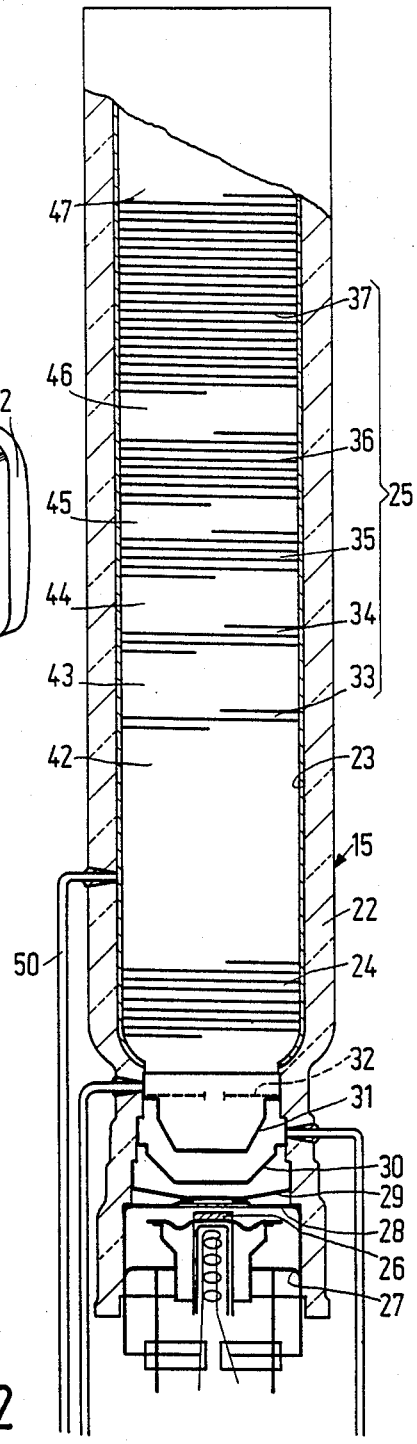
FIG. 2 is a diagrammatic longitudinal cross-section view through an electron gun used in the display tube shown in FIG. 1.

FIG. 2 shows the electron gun 15 in greater detail. The electron gun 15 comprises a tubular support of an electrically insulating material, for example a glass tube 22 which is formed by softening a glass tube section and drawing it on a mandril. Adjacent one end a series of annular steps of increasing diameter towards the terminal portion of the tube section are provided and serve as engaging surfaces for electrodes in the beam forming section of the electron gun. The remainder of the tube section has a homogeneous high ohmic resistive layer 23, for example of ruthenium oxide, provided thereon. A pre-focusing lens 24 is formed as a helix in the resistive layer together with a 5-segment helical bi-potential focusing lens 25. The lens diameter is of the order of 10 mm. In an embodiment of a projection display tube the distance between the object formed by the cross-over in the beam forming part of the electron gun and the end of the last helical segment is 73 mm and the distance between the last segment and the screen 17 is 130 mm.

The beam forming part of the electron gun comprises an indirectly heated cathode 26 which is carried by, and electrically insulated from, a drawn, thin-walled sleeve 27 which is secured to an apertured, drawn thin-walled metal sleeve 28 which constitutes a grid $g_1$. Proceeding in the direction of the electron beam path from the cathode 26, there are successively arranged apertured grids $g_2$, $g_3$ and $g_4$ formed by drawn, thin-wall metal sleeves 29, 30 and 31. Optionally a diaphragm 32 may be provided in the $g_4$ grid. The aperture in the diaphgram is large enough to pass the major part of the electron beam but small enough to prevent scattered electrons from impinging on the helical segments causing temporary increases in current flow leading to electron beam defocusing as a result of changes in the voltage distribution. By a diaphragm 32 being placed between $g_4$ and the prefocusing lens, it lies in an equipotential space and in so doing avoids distorting the electron optical characteristics of the electron gun.

The five helix segment focusing lens 25 is constituted by five helical segments 33 to 37 of constant pitch alternated with intermediate, plain cylindrical segmens 42 to 47 of the high-ohmic resistance material 23. An electrical connection is made to the segment 42 via a lead-out wire 50 to which for example a focusing voltage $V_f$ of 3 kV is applied. The segment 47 is typically at a screen voltage $V_s$ of 30 kV which is derived by making an electrical contact with a conductive layer (not shown) on the inside of the conical portion 13, the conductive layer being electrically connected to an anode button (not shown).

In operation, when the mentioned voltages are applied across the helical segments of the lens, the helical segments function as a voltage divider and the intermediate segments 43, 44,46 and 46 each acquire a different fixed potential which is determined by the ratio of the lengths of the helical segments, assuming that all of the helices are of constant pitch. By optimising the axis potential in the focusing lens, then a lens having a minimum spherical aberration for a particular magnification can be obtained. In the case of a bipotential focusing lens and constant pitch helices, it has been found that the desired optimisation can be achieved by making the length of the helical segments 33 to 37 increase gradually from the object point, that is the cross-over in the beam forming part of the electron gun, and making the length of the intermediate segments 43 to 46 decrease gradually. The minimum length of a helical segment should be one turn. In deciding on the pitch and bandwidth of the helix regard has to be paid to achieving the required potential difference of each helical segment, the reproducibility of the segments and avoiding exposing too much of the substrate length to the risk of charge build-up thereon. The choice of the band-width of the helices is influenced partly by the degree of smoothness of, or, alternatively, the irregularities in, the edges of the band. Since the helices may be formed by scratching a helical track through the resistive layer 23 or removal of the resistance material using a laser beam, the particulate size of the resistive material will have some effect on the coarseness of the edges. Consequently the width of the helical track is chosen so that the effects of any irregularities in the edges are negligible. The pitch is chosen so that the desired characteristics of electrical insulation between turns and avoidance of charge build-up are obtained. Due to the constant pitch and the homogeneous resistance, the potential along the segments increases or decreases linearly enabling an equal field strength to prevail along each segment.

With the lengths of the helical segments and the intermediate segments varying as described with reference to FIG. 2, the axis potential gradually increases or decreases in the direction of the end potential. In fact the axial potentials can be expressed in terms of the lengths. Consequently the first and notably the second derivative of this axis potential can remain low. As already mentioned in the preamble of the present specification, the spherical aberration of the electron lens is determined by the integral along the axis of $$C_s = \frac{1}{64\sqrt{V_o}} \int_p^Q \frac{R^4}{\sqrt{V^1}} \left[ 10\left(\frac{V^1}{V}\right)^4 - 10\left(\frac{V^1}{V}\right)^2 \left(\frac{V^{11}}{V}\right) + 4\left(\frac{V^{11}}{V}\right)^2 - \left(\frac{V^1}{V}\right) \cdot \left(\frac{V^{111}}{V}\right) \right] dz$$

where R is the radius of the paraxial path starting at the object point at a 1 radian angle and V, $V^1$, $V^{11}$ and $V^{111}$ are the axis potential and its derivatives. The major contribution to this integral is determined by the term with $(V^{11}/V)^2$ although the other contributions are not negligible. Arranging to increase or decrease the axis potential gradually ensures that these contributions remain low.

Figure 3:
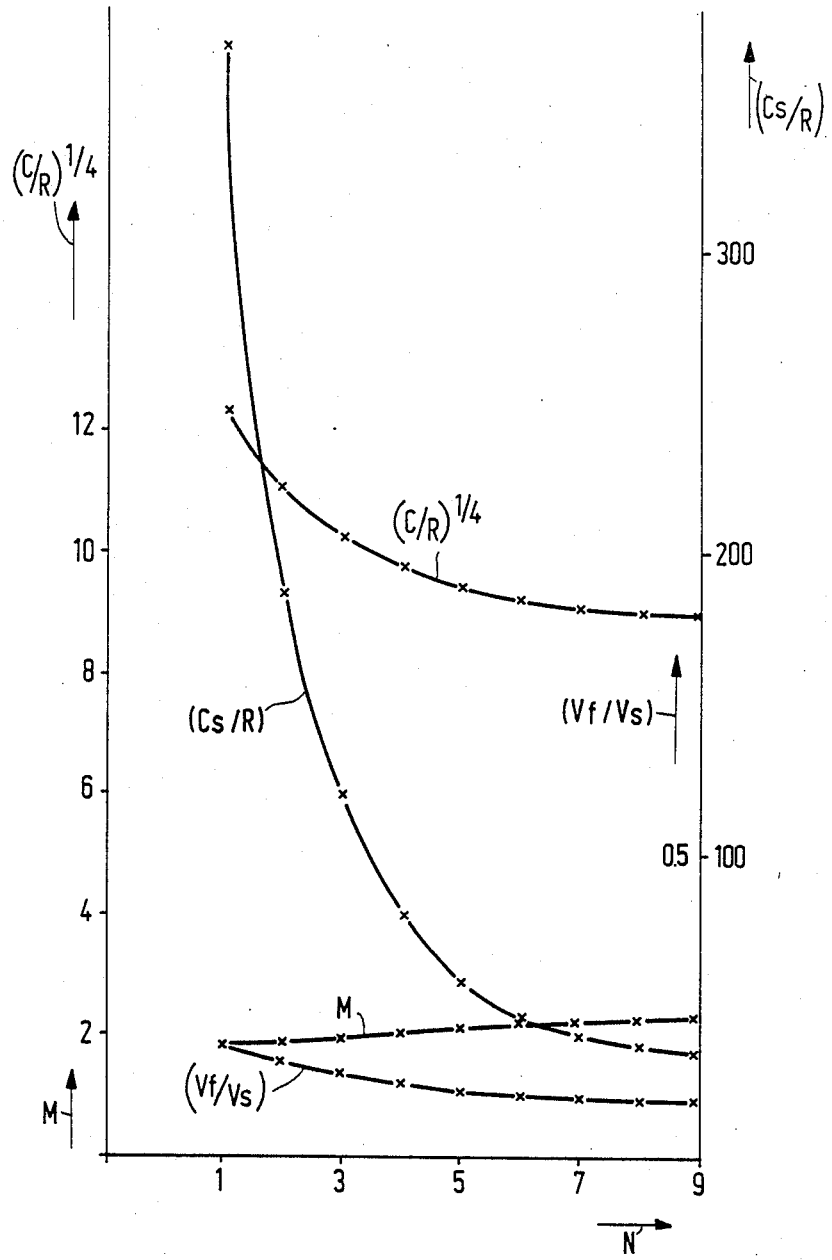
FIG. 3 shows four graphs illustrating certain characteristics of segmented electron lenses.

Referring now to FIG. 3, this shows the variation of the calculated spherical aberration coefficient $C_s$, the magnification M, the required voltage ratio $V_f/V_s$ and the factor $C^{\frac{1}{4}}$ (the smaller, the better the lens) plotted against the number (N) of segments used in respect of an embodiment having fixed distances. In FIG. 3 the left hand ordinate represents the relative values of magnification (M) and the factor $C^{\frac{1}{4}}$ divided by the lens radius (R) to the power $\frac{1}{4}$, namely $(C/R)^{\frac{1}{4}}$ and the right hand ordinate represents, on the left side, the ratio of $V_f$ (focusing voltage) to $V_s$ (screen voltage) and, on the right side, the spherical aberration coefficient $C_s$ divided by the lens radius, namely $(C_{s/R})$.

For each number of helical segments, N, the length distribution of the helical segments and the intermediate segments was optimised for the smallest value of the factor $C^{\frac{1}{4}}$. The starting point of these calculations was making the distance between the object and the end of the last helical segment equal to 73 mm, the distance between the screen and the last segment was made equal to 130 mm, the total length (L) of the helices, that is the distance from the gun side of the prefocusing helix to the screen side of the helix 37, is 63 m, and the lens diameter was made equal to 10 mm. An examination of FIG. 3 shows that the factor $(C/R)^{\frac{1}{4}}$ decreases with an increasing number of segments, but the rate of decrease is less when more than five helical segments are used. Also the spherical aberration decreases with an increasing number of lens segments. For a fixed screen voltage $V_s$, the focusing voltage $V_r$ decreases with increasing the number of segments because the lens is weaker and the magnification increases gradually.

Five helical segments have been found to provide a good compromise between the optimisation of the lens quality and the ability to make the helical lens segments having regard not only to the preceding remarks but also to the fact that computer simulations length of the shortest helical segment becomes smaller than the pitch of the helix which in the embodiment described is 350 μm.

From FIG. 3 it can be deduced that for a 5 helix segment lens the ratio $V_f/V_s$ is 0.104, magnification is 2.08, the spherical aberration divided by the radius R is 56.41 and the factor $C^{\frac{1}{4}}$ divided by the radius to the power of $\frac{1}{4}$ is 9.36. The length (l) of the helical segments and intermediate segments expressed with respect to the lens radius R, that is l/R, is

| Segment No. (See FIG. 2) | 33 | 43 | 34 | 44 | 35 | 45 | 36 | 46 | 37 |
|---|---|---|---|---|---|---|---|---|---|
| Helix | 0.11 | | 0.19 | | 0.30 | | 0.48 | | 2.68 |
| Intermediate | | 1.01 | | 0.83 | | 0.64 | | 0.43 | |

The tubular summary indicates the gradual changes in the lengths of the segments.

Figure 4:
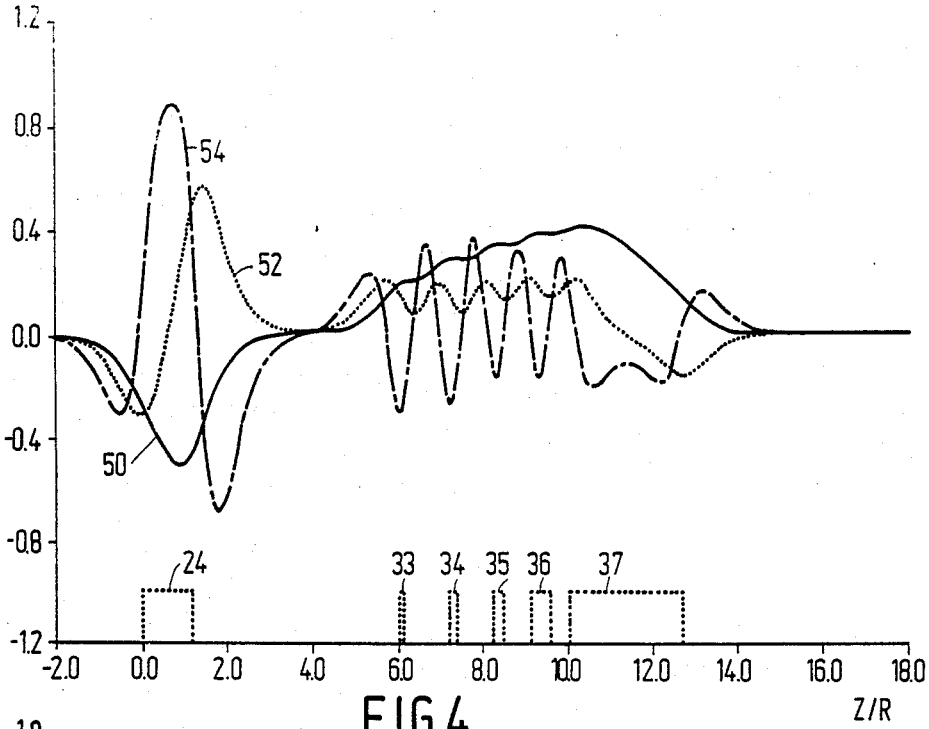
FIG. 4 shows the relative positions of a helical prefocusing lens and the segments of a 5 segment bi-potential lens in large dotted lines together with graphs of the first, second and third differentials ($V^1/V$, $V^{11}/V$ and $V^{111}/V$) of the axis potential in continuous, fine dotted and chain-dot lines, respectively.

Reference will now be made in FIGS. 4 and 5 which illustrate the variation of the axis potential and its derivatives, as well as the variation of the paraxial path and the integrand of the spherical aberration integral. The abscissa in both figures Z/R is the ratio of the axial distance to the radius. The helical prefocusing lens 24 and the helical segments 33 to 37 of the focusing and accelerating lens have been shown in FIGS. 4 and 5 in heavy dots. In FIG. 4 the curves 50, 52 and 54 represent the first, second and third derivatives of the voltage. An examination of these curves confirms that the major contribution to the integral in the expression for $C_s$ is the second derivative.

Figure 5:
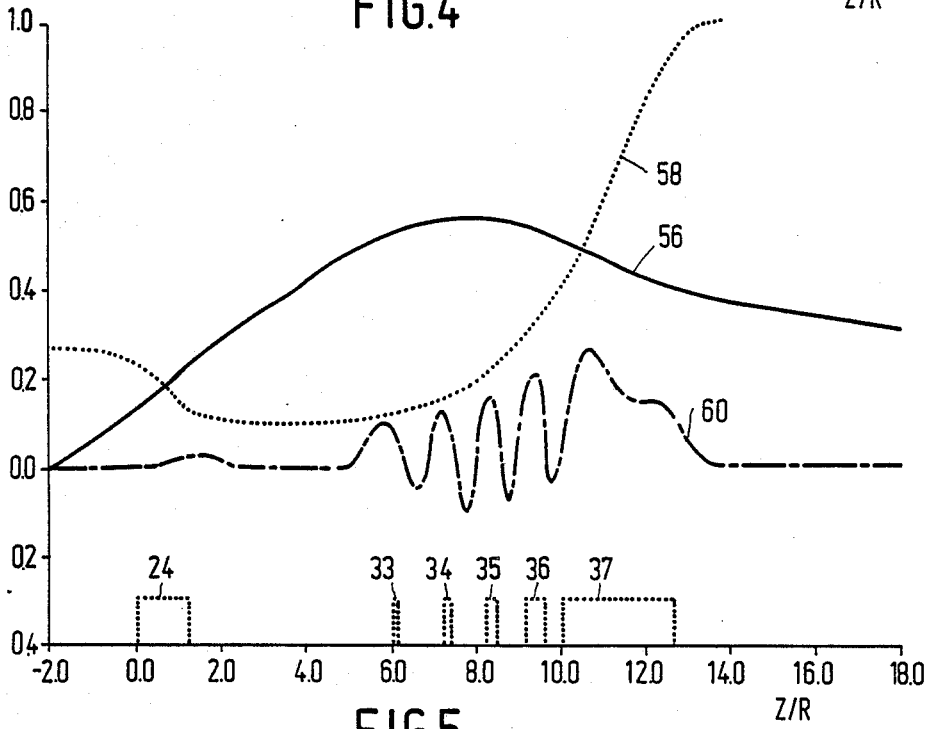
FIG. 5 shows the relative positions of a helical prefocusing lens and the segments of a 5 segment bi-potential lens in large dotted lines together with graphs of the paraxial ray as a continuous line, the axis potential as a fine dotted line and the integrand of the spherical aberration integral as a chain-dot line.

In FIG. 5, the curve 56 shows the variation in the radius of the paraxial path and illustrates how the path increases to a maximum and then decreases. An examination of lenses having different numbers of segments indicates that the maximum value decreases with an increasing number of segments. The curve 58 is of the axis potential and shows that it decreases between the pre-focusing lens 24 and the helical segment 33 and then increases steadily to a maximum of 30 kV, the ordinate scaling having been normalised to the final voltage. The fewer the number of helical segments means that the increase in voltage is shaper but the greater the number of helical segments the increase is gentler. Finally the curve 60 represents the integrand of the spherical aberration coefficient. This coefficient does decrease with increasing the number of helical segments which is confirmed by the curve $(C_{s/R})$ in FIG. 3.

Figure 6:
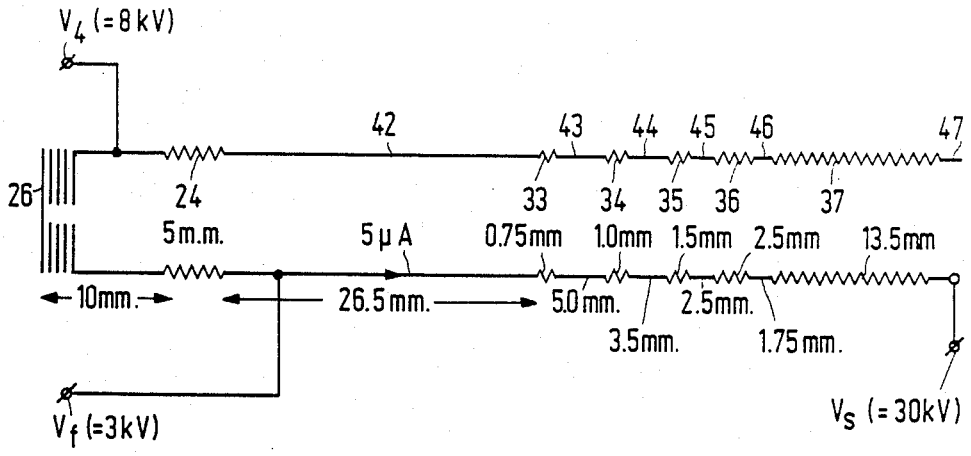
FIG. 6 illustrates schematically an embodiment of a five segment helical lens.

FIG. 6 illustrates the lengths of the constant pitch helical segments 24 and 33 to 37 and the intermediate segments 42 to 46 in millimeters of a practical embodiment of an electron gun. Also given are the voltages $V_4$ applied to the grid $g_4$, the focusing voltage $V_f$ and the screen voltage $V_s$ and that the distance from the cathode 26 to the prefocusing lens helix is 10 mm.

Figure 7:
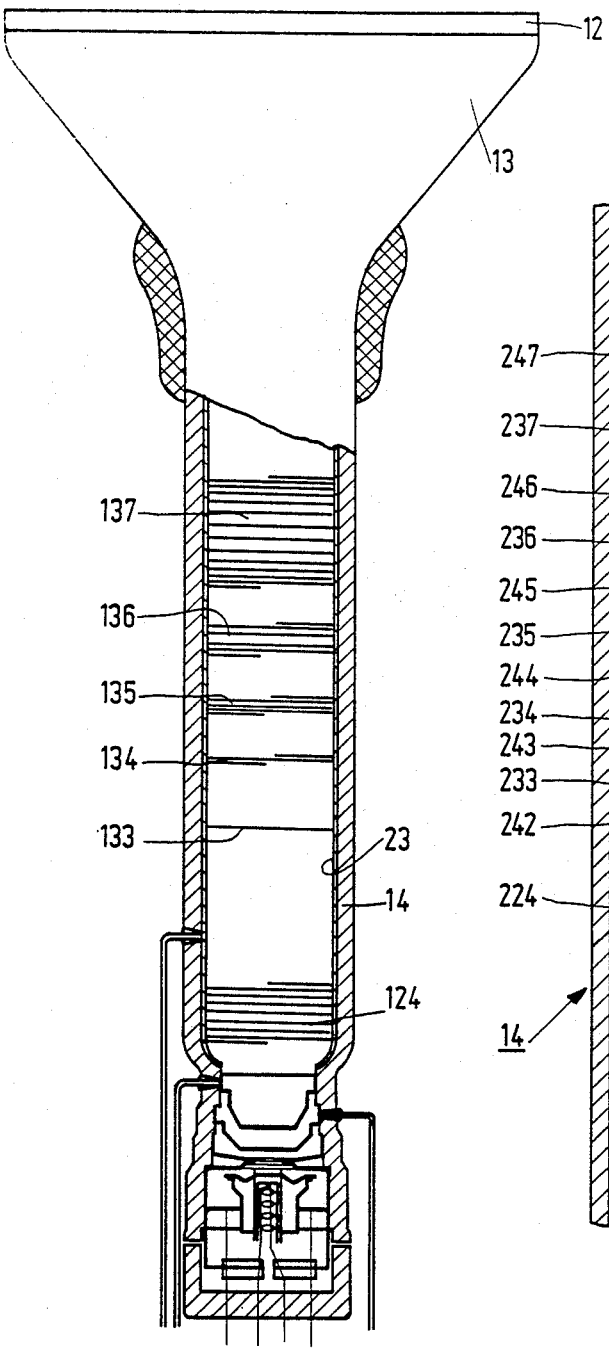
FIG. 7 is an illustrative partial longitudinal view through a single beam display tube having the helical segments provided on the wall of the tube neck.

FIG. 7 illustrates diagrammatically an embodiment of a monochrome display tube in which the helical segments of the prefocusing lens 124 and the bipotential accelerating lens, segments 133 to 137, are provided in a high-ohmic resistance layer applied to the interior of the neck 14. Also this figure illustrates that the lengths of the helical and intermediate segments vary as in FIG. 2 and also that the pitch of each helical is variable and is adapted to produce the optimum axis potential to produce minimum spherical aberration. Spaced apart variable pitch segments may be provided in the tubular substrate or glass tube 22 of FIG. 2 and conversely constant pitch segments may be provided in the neck 14 of the tube illustrated in FIG. 7.

Figure 8:
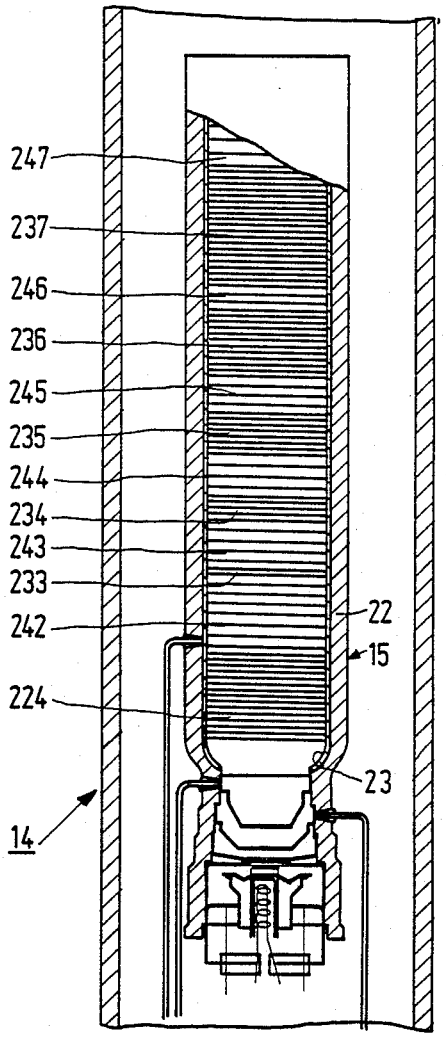
FIG. 8 is an illustrative partial longitudinal cross-sectional view through a display tube neck and the electron gun therein showing a segmented lens comprising a variable pitch helix.

FIG. 8 illustrates another embodiment of an electron gun 15 in which a continuous helix of a high-ohmic resistance material is provided on the interior of the glass tube 22. The pitch and band width of the helix are varied so that for example the helical segments of the prefocusing lens and the accelerating electron lens comprise fine constant pitch segments 224, 233, 234, 235, 236 and 237 and the intermediate segments comprise coarse constant pitch segments 242 to 247. As in the previously described embodiments the length of the helical and intermediate segments are varied as required.

In an alternative arrangement of the electron gun shown in FIG. 8 the pitch of the turns in each of the helices may vary continuously to obtain the required axis potential.

Figure 9:
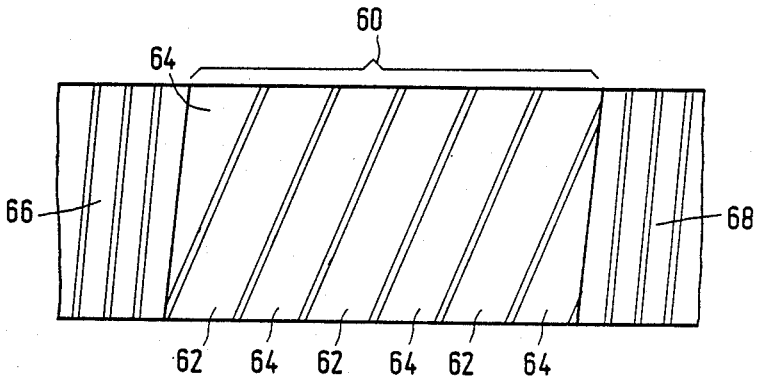
FIG. 9 illustrates one method by which a coarsely wound helix may be obtained by using two interleaved helices.

FIG. 9 illustrates diagrammatically how a coarsely wound helix 60 may be obtained without the risk of substrate charging. The helix 60 in reality comprises two interleaved coarsely would helices 62, 64 which at their ends are connected to the finely wound helics 66, connected in parallel so that the voltage drop across the helix 60 is half that when it comprised only the helix 62 or 64.

Using 5 helical segments as described has realised 24% improvement in $C_4^1$ compared to a lens consisting of one segment of constant pitch, the maximum achievable improvement being 30%. However the limitation on having seven or more helical segments is that the shortest segment becomes so small that it is just one turn long. The influence of inhomogeneity of the resistance of the layer will also become noticeable in this case.

The illustrated embodiments of the present invention have been of accelerating lenses of the bipotential type, however it is also possible to make other lenses, such as unipotential lenses in segmented form. In the case of a unipotential lens the helical segment length will have to increase gradually from the point which is at the focus voltage, whereas the length of the intermediate segments decreases.

A method of manufacturing segmented lenses of the type described is disclosed in unpublished Netherlands Patent Application No. 8600391 filed Feb. 17, 1986. However in the interests of completeness this method will now be summarised.

A glass tube 22 which comprises a cylindrical insulating substrate is shaped by drawing on a bipartite mandril, the parts of which after drawing are removed from the glass tube in opposite directions. Such a technique enables the places of increasing diameter to be obtained with a high reproducibility and accuracy. Next electrical contacts are inserted at predetermined positions in the tube wall. This is done by sand-blasting conical holes in the tube wall. Indium balls are inserted into the holes together with the lead-out wires and each assembly is fused in its respective hole by means of a conventional crystallizing glass. Any part of the wires and/or indium balls protruding into the tube are cut-off flush. The high ohmic resistance layer, for example ruthenium oxide, is then applied as a suspension to the interior of the glass tube and allowed to dry.

The helical segments are formed by rotating the glass tube about its longitudinal axis at a constant speed and scratching the helical form at the area of the segments by means of a chisel which is slowly moved parallel to the axis. The pitch of the helix is for example 300 μm and the interruption in the resistance layer is for example 60 μm. After a firing treatment, the interruptions are highly voltage resistance. The thickness of the layer is of the order of 1.3 μm.

The electrodes of the beam forming section which are preformed cup-shaped members are inserted into the glass tube and engage the close tolerance surfaces preformed in the tube.

Other suitable materials for the high-resistance layer are manganese oxide, nickel oxide and thallium oxide.

As mentioned earlier the helics may be formed by using a laser to burn a track in the layer 23.

Although the present invention has been described with reference to electron guns having a focusing lens formed by a resistive layer provided on a circularly cylindrical substrate, non-circularly symmetrical substrates may be used as well as substrates whose cross-sectional area changes, for example conical substrates.

The required voltage distribution along the axis of the electron gun can be obtained by varying the thickness of the high-ohmic resistance layer for example in accordance with a succession of cylindrical areas of different lengths with or without helices. Alternatively the required voltage distribution along the axis of the electron gun can be obtained by varying the resistivity of the high ohmic resistance layer in bands of different lengths, with or without helices, by altering the temperature distribution during baking out.

In the illustrated embodiments of the present invention an external connection has been shown connected to $g_4$ and thereby the pre-focusing lens. However such an external connection can be avoided where appropriate by connecting the grid $g_4$ to an appropriate point in the helical main lens.

The present invention is not restricted to electron beam devices having a single electron gun. Combinations of these electron guns can be fabricated from use in say an in-line electron gun shadow mask display tube. Additionally an integral multiple electron gun can be made by having a suitably shaped tubular substrate and providing helices on the inside of this substrate.

What is claimed is:

1. An electron beam device including an electron gun comprising electron-beam means for producing an electron beam directed toward a surface, and focusing means for producing a spherical aberration corrected electric focusing lens field for focusing the electron beam to a spot on the surface, said focusing means, comprising:

a. elongate tubular substrate consisting essentially of an electrically insulating material, said elongate tubular substrate being disposed around a central axis thereof and being positioned with respect to the electron beam means for passing the electron beam therethrough;

b. a resistive layer on an internal surface of the substrate, saied layer being configured to form along the substrate length a plurality of helical segments separated by intermediate segments, said helical segments each comprised of a helix having an axial length, respective axial lengths of the helical segments increasing along the path followed by the electron beam and respective axial lengths of the intermediate segments decreasing along the path followed by the electron beam; and c. electrical connections, disposed at positions along the resistive layer length which are separated by the succession of segments, for enabling application to the resistive layer of respective voltages for effecting production along said length of a potential distribution determined by the arrangement of resistive layer segments.

2. An electron beam device as in claim 1 where the intermediate segments comprise continuous tubular sections of the resistive layer.

3. An electron beam device as in claim 1 where the intermediate segments comprise helical sections of the resistive layer.

4. An electron beam device as in claim 3 where the helical segments each have a first constant pitch and the helical sections each have a second constant pitch, the first pitch being different from the second pitch.

5. An electron beam device as in claim 4 where at least one of the intermediate segments comprises first and second interleaved helical sections.

6. An electron beam device as in claim 1 where each of the helical segments has a constant pitch.

7. An electron beam device as in claim 1 where at least one of the helical segments has a varying pitch.

8. An electron beam device as in claim 1 where the focusing means has five of said helical segments.

9. An electron beam device as in claim 1 where the focusing means includes means for prefocusing the electron beam formed by a helical segments of the resistive layer disposed upstream of said helical segments with respect to the path of the electron beam.

10. An electron beam device as in claim 1 where the resistive layer consists essentially of ruthenium oxide.

11. An electron beam device as in claim 1 including a diaphragm disposed adjacent an end of the elongate tubular substrate adjacent the electron-beam means for preventing scattered electrons from impinging on the resistive layer.

12. An electron beam device as in claim 1 including an envelope containing the electron gum, said elongate tubular substrate comprising a part of the envelope.

* * * * *